United States Patent [19]

Fröhlich

[11] Patent Number: 4,707,901

[45] Date of Patent: Nov. 24, 1987

[54] PROCESS AND APPARATUS FOR MAKING COUPLED SLIDE FASTENERS

[75] Inventor: Alfons Fröhlich, Essen, Fed. Rep. of Germany

[73] Assignee: Opti Patent-, Forschnungs-und Fabrikations-AG, Riedern-Allmeind, Switzerland

[21] Appl. No.: 885,074

[22] Filed: Jul. 14, 1986

[30] Foreign Application Priority Data

Jul. 13, 1985 [DE] Fed. Rep. of Germany ..... 3525133

[51] Int. Cl.[4] ..... B21D 53/50; B21F 45/18; B29D 5/00; A41H 37/06

[52] U.S. Cl. ..... 29/408; 29/766

[58] Field of Search ..... 29/408, 409, 410, 428, 29/766, 767, 768, 769

[56] References Cited

U.S. PATENT DOCUMENTS

| | | | |
|---|---|---|---|
| 4,110,890 | 9/1978 | Akashi | 29/766 X |
| 4,368,570 | 1/1983 | Morita | 29/409 X |
| 4,466,168 | 8/1984 | Hatagishi | 29/409 |
| 4,520,544 | 6/1985 | Morita et al. | 29/408 |

FOREIGN PATENT DOCUMENTS

| | | | |
|---|---|---|---|
| 2165303 | 4/1986 | United Kingdom | 29/766 |

*Primary Examiner*—Howard N. Goldberg
*Assistant Examiner*—Ronald S. Wallace
*Attorney, Agent, or Firm*—Karl F. Ross; Herbert Dubno

[57] ABSTRACT

A coupled slide fastener strip is gripped by at least one clamping member adjacent where a cut is to be made in it on one side at the beginning of a leading coupled slide fastener and on the other side at the end of a trailing coupled slide fastener and then the leading coupled slide fastener is separated from the slide fastener strip held by the clamping members by cutting. Then subsequently, the end piece is mounted at the end position the trailing coupling slide fastener with a clamping member and substantially simultaneously, the leading coupled slide fastener separated from the coupled slide fastener strip is moved with that or another clamping member from a cutting position into a slider drawing position. In the slider drawing position the slider is drawn in the opening direction of the coupled slide fastener and optionally the beginning piece is mounted. After that, the slider is drawn in the closing direction. Finally, the separated trailing coupled slide fastener is released for stacking and the clamping members are repositioned in the cutting position.

6 Claims, 4 Drawing Figures

PROCESS AND APPARATUS FOR MAKING COUPLED SLIDE FASTENERS

FIELD OF THE INVENTION

My present invention relates to a method or a process for making coupled slide fasteners each having an end piece (end-stop member), a slider and, optionally, a beginning piece (or starting-end and-stop member) with an automatic final assembler. It also relates to an apparatus in the form of automatic final assembler required to perform this process.

BACKGROUND OF THE INVENTION

A known process for making a series of coupled slide fasteners of a predetermined length each provided with an end piece, a slider and optionally a beginning piece from a continuous coupled slide fastener strip with an automatic final assembler having a tool for application of the end piece and/or the beginning piece, a slider-drawing mechanism and a separating mechanism with a cutting knife comprises moving the coupled slide fastener strip stepwise cyclically and according to the length of the coupled zipper, mounting the end piece and/or the beginning piece in a cycle pause, drawing the slider on the coupled slide fastener and separating the individual coupled slide fasteners by cutting.

The earlier method, furthermore, specifically comprises gripping the coupled slide-fastener strip by at least one clamping member adjacent the location at which the cut is to be made in the coupled slide fastener strip on one side at the beginning of a leading coupled slide fastener and on the other side at the end of a trailing coupled slide fastener and then cutting the coupled slide fastener strip.

The coupled slide fasteners can have continuous rows of coupling elements of plastic (synthetic resin) monofilament, metal slide fastener elements or other slide fastener elements of plastic.

The beginning pieces form a stop for the slider and are positioned at the open or spreadable end of the manufactured zipper.

The end piece is mounted at the opposite end. The end piece can, in a separable slide fastener be also separated and constructed from suitable elements. The apparatus can have tools for mounting metal beginning pieces and end pieces. When the beginning and end pieces are made from plastic, these slide fastener members can be thermally fused from the coupling elements with or without addition of further plastic material.

In current practice, the separation and thus the cutting operation occurs following the end piece mounting operation. That means that the individual process steps and measures are performed on a web or strand of assembled slide fastener segments. The beginning part and/or end part of these slide fastener segments always must be taken and positioned anew in the cutting apparatus. Thus inaccuracies result. Moreover the expense, particularly in regard to the drive and control mechanisms, is comparatively large. Finally disturbingly long cycle times result from the above described procedure.

OBJECTS OF THE INVENTION

It is an object of my invention to provide an improved process and apparatus for making coupled slide fasteners each provided with an end piece, a slider and optionally a beginning piece, whereby the drawbacks of earlier approaches are avoided.

It is also an object of my invention to provide an improved process and apparatus for making coupled slide fasteners each provided with an end piece, a slider and optionally a beginning piece in which the end piece and the beginning piece are mounted with improved precision and without new positioning or alignment of slide fastener segments in the apparatus.

It is a further object of my invention to provide an improved process and apparatus for making coupled slide fasteners each provided with an end piece, a slider and optionally a beginning piece in which fabrication and capital costs are reduced.

It is yet another object of my invention to provide an improved process and apparatus for making coupled slide fasteners each provided with an end piece, a slider and optionally a beginning piece in which a shorter cycle time is provided.

SUMMARY OF THE INVENTION

These objects and others, which will become more readily apparent hereinafter, are attained in a process for making a plurality of coupled slide fasteners of a predetermined length each provided with an end piece, a slider and optionally a beginning piece from a continuous coupled slide fastener strip comprising moving the coupled slide fastener strip stepwise cyclically and according to the length of the coupled zipper, mounting the end piece and optionally the beginning piece in an operating cycle pause, drawing the slider on the coupled slide fastener and separating the individual ones of the coupled slide fasteners by a cut.

The process further comprises more specifically gripping the coupled slide fastener strip by at least one clamping member adjacent where the cut is to be made in the coupled slide fastener strip on one side at the beginning of a leading one of the coupled slide fasteners and on the other side at the end of a trailing one of the coupled slide fasteners and then cutting the coupled slide fastener strip. The above process is performed with an apparatus comprising an automatic final assembler with a tool or tools for application of the end piece and/or the beginning piece, a slider drawing mechanism and a separating mechanism with a cutting knife.

According to my invention, in each operating cycle, during a pause in the incremental advance of the continuous strip in units equal to the said length, first the cut is made, then subsequently the end piece is mounted at a position for the end piece at the end of the trailing coupled slide fastener with the help of one clamping member and simultaneously the leading coupled slide fastener separated from the coupled slide fastener strip is moved with the help of the one or another clamping member from a cutting position into a slider drawing position, in the slider drawing position the slider is drawn in the opening direction of the coupled slide fastener and optionally the beginning piece is mounted, and after that the slider is drawn in the closing direction and finally the separated trailing coupled slide fastener is released for stacking and the clamping members are repositioned in the cutting position, in order to take the trailing slide fastener with its end piece in the next cycle as the leading slide fastener and so forth. These steps are carried out automatically and in succession.

In the process of my invention the slide fastener strip is clamped only once near where the beginning piece and the end piece are applied with a clamping member which again releases the clamped slide fastener strip at the leading slide fastener when the slide fastener is stacked and at the trailing slide fastener in order to bring this into the position of the leading one. The process acccording to my invention can, therefore, be performed with greater speed. That is particularly true when the separated leading slide fastener is moved transversely to the feed direction in the vertical direction into a slider drawing position. The separated leading slide fastener can, however, with the help of its clamping member, be moved transversely in the horizontal direction into a slider drawing position. The required separation to allow the slider to be drawn onto the leading severed edge, however, can also be made by motion in the feed direction.

Furthermore, the beginning regions and the end regions of the slide fastener can be interchanged within the scope of my invention. The drawing of the slider is then particularly easy when the slider is pushed with its grip suspended below it. Mounting of a beginning piece is not required when the slide fastener is made without it as is frequently done in packing.

An automatic final assembler for performing my process comprises an end piece mounting unit with a feed mechanism, an end piece securing mechanism, a separating mechanism with a cutting knife and a first clamping member for a trailing one of the plurality of coupled zippers, a beginning mounting unit with a beginning securing mechanism and a second clamping member as well as an auxiliary slider drawing mechanism, the end piece mounting unit and the beginning mounting unit are positioned following each other in a cutting position in the feed direction of the coupled slide fastener strip and beside each other with the first and second clamping members and the slide fastener drawing mechanism is mounted spaced beside or below the end piece mounting unit, and the beginning mounting unit is movable between a cutting position and a slide fastener drawing position adjacent or in front of the slide fastener drawing mechanism.

BRIEF DESCRIPTION OF THE DRAWING

The above and other objects, features and advantages of my invention will become more readily apparent from the following specific description, reference being made to the accompanying highly diagrammatic drawing in which.

SPECIFIC DESCRIPTION

Figure 1:
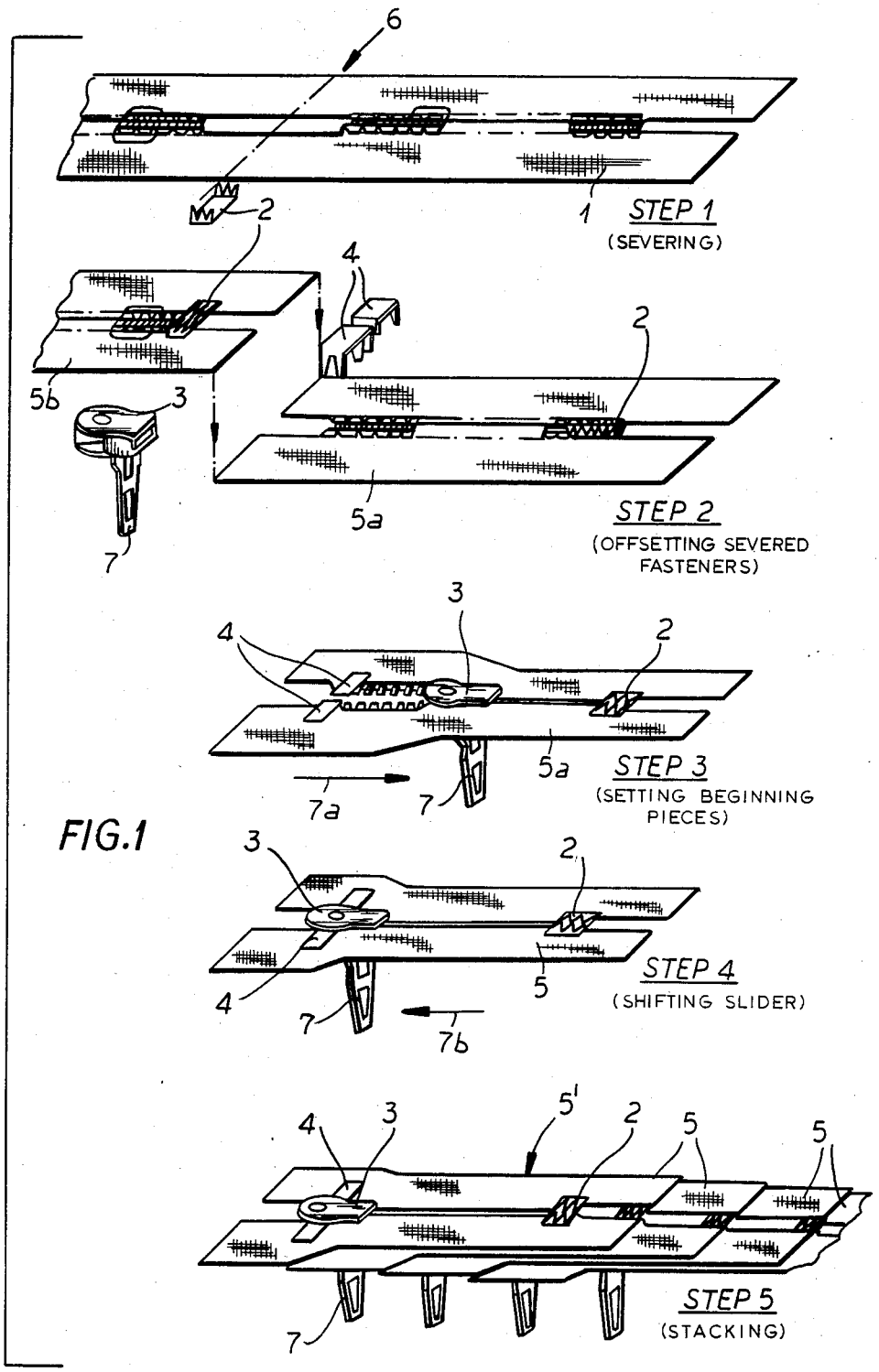
FIG. 1 is a diagram showing the steps of the process for making coupled slide fasteners according to my invention.

FIG. 1 shows the process steps and hence the kinematics of the mechanism which is essential for the process according to my invention, the machine parts being omitted so that the positions of parts of the slide fastener can be seen.

FIG. 1 shows a coupled slide fastener strip 1 entering from the left from which a finished coupled slide fastener 5 provided with end piece 2, slider 3 and in this case beginning piece 4 can be made. The slide fastener strip 1 moves intermittently stepwise and in steps equal to the length of the manufactured slide fastener strip 5 in the feed direction. During the pause in the feed the end piece 2 and the beginning piece 4 are attached and also the slider 3 is drawn up. FIG. 1 shows the action during this pause in the feed. The finished separated coupled slide fastener 5 is stacked.

First a separating cut 6 is made in the slide fastener strip 1 and, of course, between clamps illustrated later in FIGS. 2 to 4. Then the end piece 2 is mounted on the end of the trailing slide fastener **5*b*** held in the cutting position I.

The leading slide fastener **5*a* separated by the separating cut 6 from the slide fastener strip 1, is moved transversely to the feed direction of the slide fastener strip 1** into the slider drawing position II.

In this slider drawing position II the slider 3 is drawn in the opening direction **7*a*. That happens in the example from left to right in FIG. 1. After that the beginning piece 4 is mounted. The slider 3 is then drawn back in the closing direction 7*b* up against the beginning piece 4. Now that this slide fastener 5 is ready it can be released for stacking. In the example the motion occurs transverse to the feed direction of the slide fastener strip 1 in the vertical direction. It can also occur in the horizontal direction. The slider 3 may be drawn with its grip 7** depending from it.

Figure 2:
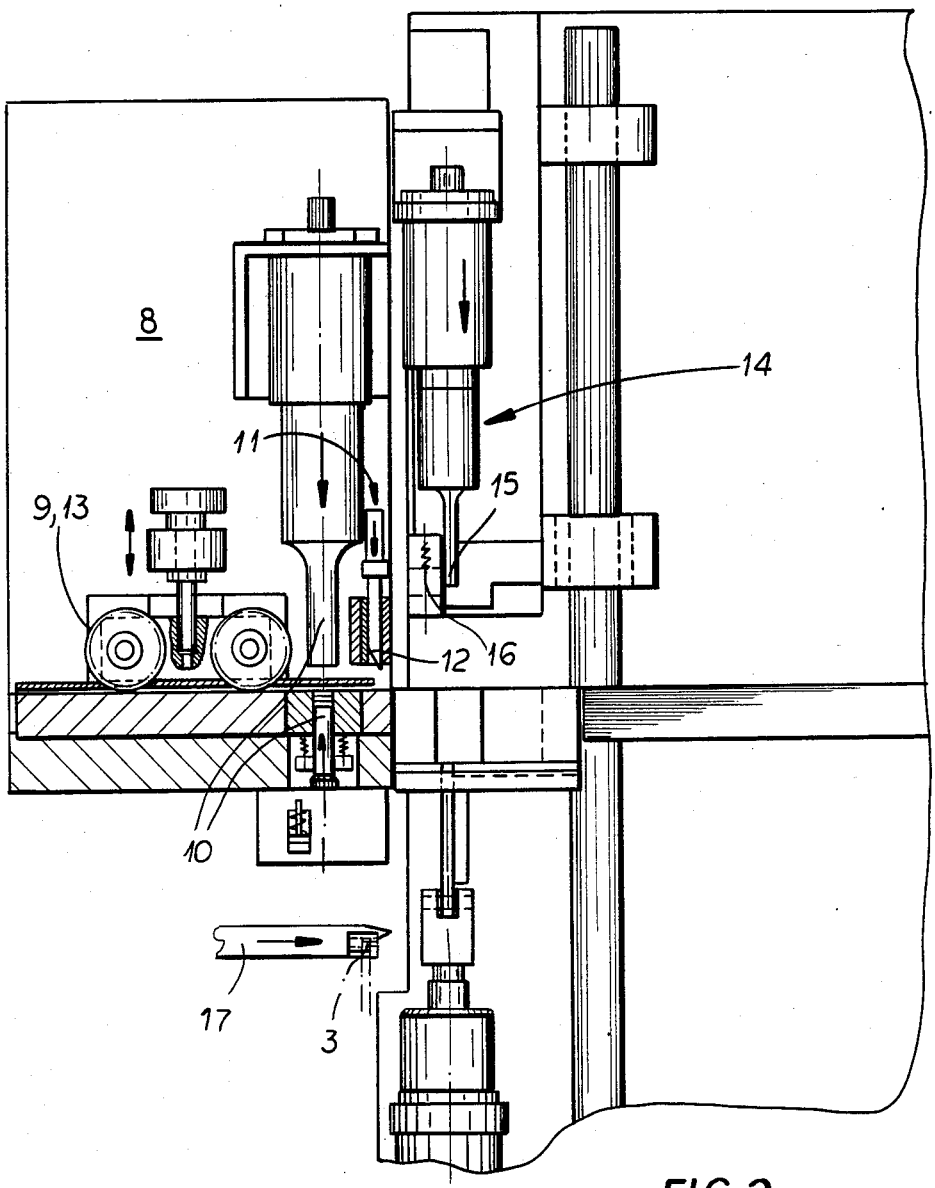
FIG. 2 is a side sectional view of an automatic final assembler for making coupled slide fasteners according to my invention.
Figure 3:
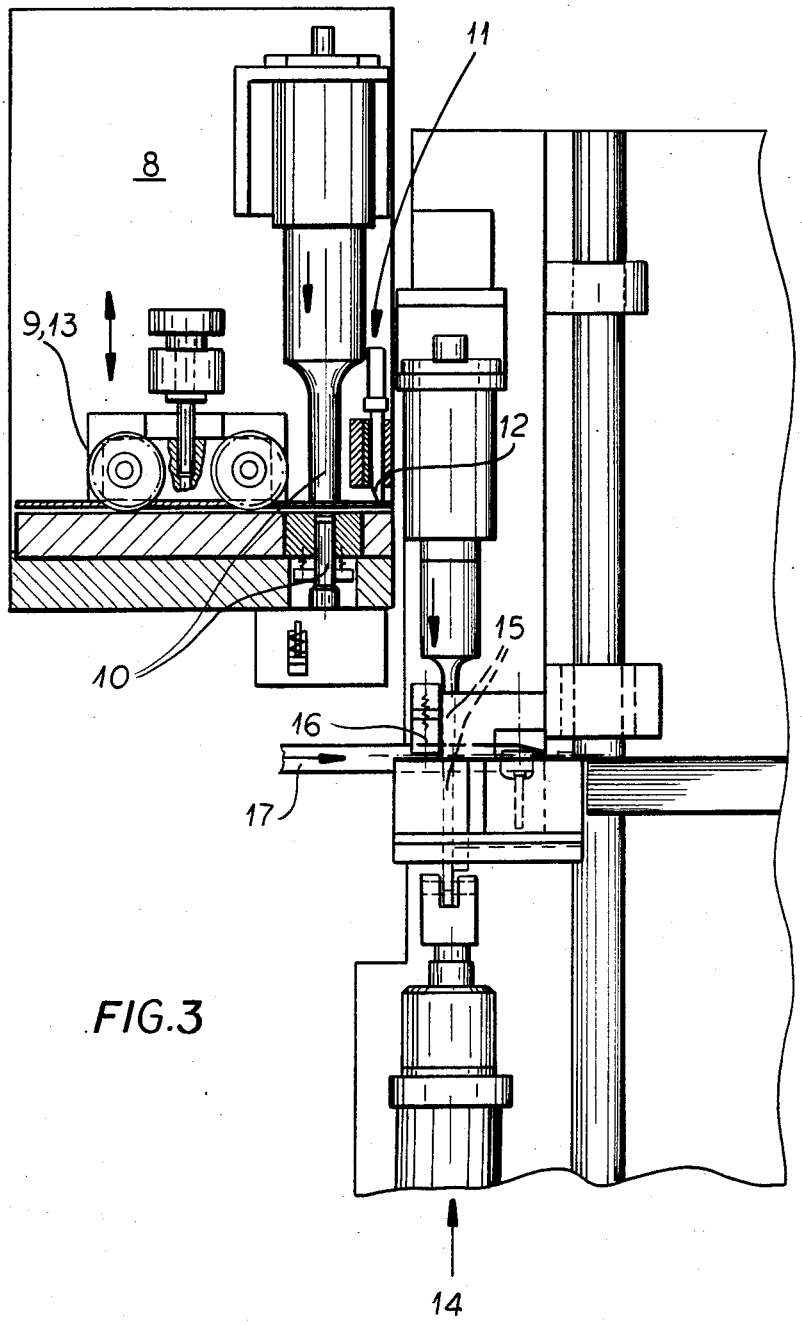
FIG. 3 is a side sectional view of the apparatus of FIG. 2 in a different operating configuration.
Figure 4:
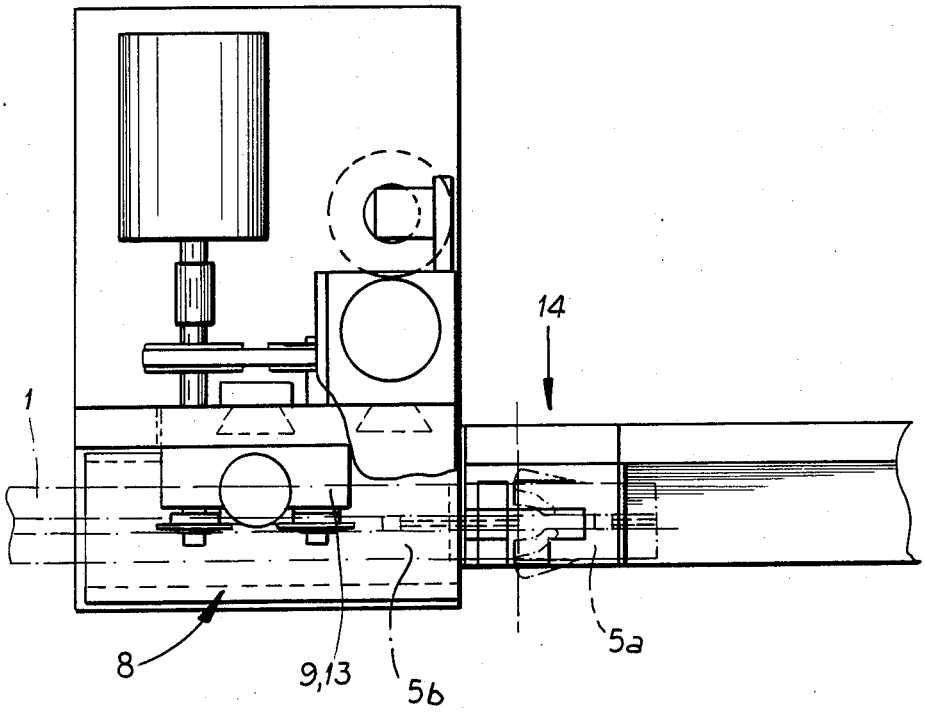
FIG. 4 is a top view of the apparatus according to FIG. 2.

From a comparison of FIGS. 2 to 4 it can be seen that the automatic final assembler, which is equipped to perform the process of my invention, comprises an end piece mounting unit 8 with feed mechanism 9, end piece securing mechanism 10, separating mechanism 11 with cutting knife 12 and a first clamping member 13 for the trailing slide fastener **5*b*, a beginning piece mounting unit 14 with beginning piece securing mechanism 15, a second clamping member 16 for the leading slide fastener 5*a* and a slider drawing mechanism 17**.

The end piece mounting unit 8 and the beginning piece mounting unit 14 in the cutting position I (FIG. 2 and FIG. 4) are positioned following each other in the feed direction and with their first and second clamping members 13 and 16 next to each other while the slider drawing mechanism 17 is positioned next to or below end piece mounting unit 8 and spaced from it. The beginning piece mounting unit 14 is movable between its cutting position I and the slider drawing position II adjacent or in front of the slider drawing mechanism 17.

The kinematics of the process proceed according to my invention so that the slide fastener strip 1 immediately adjacent where the separating cut 6 is to be made is gripped on one side on the beginning portion of the leading slide fastener **5*a* and on the other side on the end of the trailing slide fastener 5*b* by first and second clamping members 13 and/or 16 and after that the cut is made between the first and second clamping members 13 and 16**.

Subsequently to the cutter, at the end of the trailing slide fastener **5*b* held fixed with first clamping member 13 in its cutting position I, the end piece 2** is mounted.

More or less simultaneously, the leading slide fastener **5*a* separated from the slide fastener strip 1 with the help of second clamping member 16 is moved from the cutting position I transverse to the feed direction of the slide fastener strip 1** into a slider drawing position II.

In the slider drawing position II the slider 3 with the help of the projecting slider drawing mechanism 17 is drawn in the opening direction **7*a*** of the slide fastener 5a at the beginning of the leading slide fastener 5a and the beginning piece 4 is mounted.

At that time, or after it, the drawn slider 3 is drawn back in the closing direction 7b against the beginning piece 4. Consequently, the leading slide fastener 5a can be released as a finished slide fastener for the stack 5' and the corresponding second clamping member 16 is moved back into the cutting position I in order in the next operating cycle to take the trailing slide fastener 5a with its ready end piece 2 as the leading one.

In the embodiment shown in the drawing the beginning securing mechanism 15 and the end securing mechanism 10 operate using ultrasonics, the beginning piece 4 and the end piece 5 are made from slide fastener members comprising plastic material by molding them from the coupling elements adding material, if desired.

The first and second clamping members 13 and 16 can also be used as feeders for the slide fastener strip 1 if they are feed rollers.

I claim:

1. In a process for making a plurality of coupled slide fasteners of a predetermined length each provided with an end piece, a slider and optionally a beginning piece from a continuous coupled slide fastener strip, comprising moving said coupled slide fastener strip stepwise cyclically in increments of said length of said coupled zipper, mounting said end piece and optionally said beginning piece in a pause between increments of movements, drawing said slider on said coupled slide fastener and separating the individual ones of said coupled slide fasteners by cutting, wherein:

said coupled slide fastener strip is gripped by at least one clamping member adjacent a location at which said cut is to be made in said coupled slide fastener strip on one side at the beginning of a leading one of said coupled slide fasteners and on the other side at the end of a trailing one of said coupled slide fasteners and then cutting said coupled slide fastener strip, the improvement wherein:

during each pause, first said cut is made, then subsequently said end piece is applied to a position for said end piece at the end of said trailing one of said coupled slide fasteners with the help of one of said clamping members and substantially simultaneously said leading one of said coupled slide fasteners separated from said coupled slide fastener strip is moved with said one or another of said clamping members from a cutting position into a slider drawing position, in the slider drawing position said slider is drawn in the opening direction of said coupled slide fastener and after that optionally said beginning piece is mounted, then said slider is drawn in the closing direction and finally said leading one of said coupled slide fasteners is released for stacking and said clamping members are repositioned in said cutting position.

2. The improvement according to claim 1 wherein said leading one of said coupled slide fasteners separated from said coupled slide fastener strip is moved with the help of said second one of said clamping members transverse to the feed direction of said coupled slide fastener strip in a vertical direction into said slider drawing position.

3. The improvement according to claim 1 wherein said leading one of said coupled slide fasteners separated from said coupled slide fastener strip is moved with the help of said second one of said clamping members transverse to the feed direction of said coupled slide fastener strip in a horizontal direction into said slider drawing position.

4. The improvement according to claim 1 wherein said slider has an operating handle hung thereon by which said slider can be pulled.

5. A process for making a plurality of coupled slide fasteners of a predetermined length each provided with an end piece, a slider and optionally a beginning piece from a continuous coupled slide fastener strip comprising:

(a) moving said coupled slide fastener strip stepwise cyclically in increments of said length of said coupled slide fastener, separated by a cycle pause;

(b) gripping said coupled slide fastener strip by at least one clamping member adjacent a location at which where a cut is to be made in said coupled slide fastener strip on one side at the beginning of a leading one of said coupled slide fasteners and on the other side at the end of a trailing one of said coupled slide fasteners;

(c) cutting said coupled slide fastener strip held by each of said clamping members to separate said leading one of said coupled slide fasteners and in a subsequent cycle with a following cut said trailing one of said coupled slide fasteners from said strip;

(d) mounting said end piece on a position for said end piece on said trailing one of said coupled slide fasteners at said end adjacent said leading one of said coupled slide fasteners with the help of one of said clamping members;

(e) substantially simultaneously moving said leading one of said coupled slide fasteners separated from said coupled slide fastener strip with the help of another or said one of said clamping members from a cutting position into a slider drawing position;

(f) in the slider drawing position drawing said slider in an opening direction and after that optionally mounting said beginning piece on said leading one of said coupled slide fasteners;

(g) pulling said slider in a closing direction opposite to said opening direction;

(h) releasing the separated leading one of said coupled slide fasteners for stacking;

(i) repositioning each of said clamping members into said cutting position; and (j) stacking said leading one of said coupled slide fastener separated from said coupled slide fastener strip.

6. An automatic final assembler for making a plurality of coupled slide fasteners of a predetermined length each provided with an end piece, a slider and optionally a beginning piece from a continuous coupled slide fastener strip comprising:

an end piece mounting unit with a feed mechanism, an end piece securing mechanism, a separating mechanism with a cutting knife and a first clamping member for a trailing one of said plurality of coupled zippers, a beginning piece mounting unit with a beginning-piece-securing-mechanism and a second clamping member as well as a slider drawing mechanism, said end piece mounting unit and said beginning piece mounting unit being positioned following each other in a cutting position in the feed direction of said coupled slide fastener strip and beside each other with said first and second clamping members and said slide fastener drawing mechanism being mounted spaced beside or below said end piece mounting unit, said beginning piece mounting unit being movable between a cutting position and a slider drawing position adjacent or in front of said slider drawing mechanism.

* * * * *